US012642379B2

(12) United States Patent
Kane et al.

(10) Patent No.: US 12,642,379 B2
(45) Date of Patent: Jun. 2, 2026

(54) HANGER WITH ROTATING HANGER BODY

(71) Applicant: MACNEIL IP LLC, Bolingbrook, IL (US)

(72) Inventors: Stephen Kane, Cedar Lake, IN (US); Frederick W. Masanek, Jr., Barrington, IL (US)

(73) Assignee: MACNEIL IP LLC, Bolingbrook, IL (US)

( * ) Notice: Subject to any disclaimer, the term of this patent is extended or adjusted under 35 U.S.C. 154(b) by 0 days.

(21) Appl. No.: 18/767,470

(22) Filed: Jul. 9, 2024

(65) Prior Publication Data

US 2026/0013655 A1 Jan. 15, 2026

(51) Int. Cl.
*A47G 25/32* (2006.01)

(52) U.S. Cl.
CPC ..... *A47G 25/32* (2013.01)

(58) Field of Classification Search
CPC ..... A47G 25/32; A47G 25/14–1478; A47G 25/48; A47G 25/482; A47G 25/483; A47G 25/485; A47G 25/487
See application file for complete search history.

(56) References Cited

U.S. PATENT DOCUMENTS 2,895,657 A * 7/1959 Laughton ..... A47G 25/32 D6/318
3,963,154 A 6/1976 Schwartz et al.
4,074,838 A 2/1978 Blasnik et al.
4,266,677 A * 5/1981 Dewsnap ..... G09F 5/00 211/113
4,739,912 A * 4/1988 Klawieter ..... A47G 25/32 211/115
4,981,242 A * 1/1991 Grahm ..... A47G 25/20 223/89
4,984,721 A * 1/1991 Eiley ..... A47G 25/485 223/91
5,074,445 A * 12/1991 Chen ..... A47G 25/32 211/116
5,398,984 A * 3/1995 Elder ..... B60R 7/10 294/142
5,732,921 A 3/1998 Lemire
5,975,385 A * 11/1999 See ..... A47G 25/443 223/94
6,260,746 B1 * 7/2001 Abdi ..... A47G 25/32 223/92
7,264,213 B2 9/2007 Liu
7,389,885 B2 * 6/2008 Masanek, Jr. ..... A47F 7/163 223/DIG. 2

(Continued)

FOREIGN PATENT DOCUMENTS

DE 102021212015 * 4/2023 ..... A47G 25/32

*Primary Examiner* — Alissa J Tompkins
(74) *Attorney, Agent, or Firm* — Perkins IP Law Group LLC; Jefferson Perkins

(57) ABSTRACT

A downwardly facing first bushing surface is formed on a lower end of a cylindrical receiver surface of a hanger body. A barb formed on the end of a shank of a hook portion has an upwardly facing second bushing surface. The second bushing surface supports the hanger body through the first bushing surface. The first bushing surface is rotationally slidable on the second bushing surface, permitting the hanger body, and an article suspended by it, to assume any of a number of angular positions relative to a display bar axis.

14 Claims, 9 Drawing Sheets

(56) References Cited

U.S. PATENT DOCUMENTS

| | | | | |
|---|---|---|---|---|
| 10,758,064 | B2 * | 9/2020 | Carr | A47F 5/0006 |
| 11,357,348 | B2 | 6/2022 | Lorenzo et al. | |
| D968,210 | S * | 11/2022 | Jung | D9/415 |
| 2005/0184109 | A1 * | 8/2005 | Goldman | A47G 25/485 223/95 |
| 2016/0045050 | A1 * | 2/2016 | Hall | A47G 25/442 223/85 |

* cited by examiner

HANGER WITH ROTATING HANGER BODY

BACKGROUND OF THE INVENTION

Certain flat articles lend themselves to display and storage by being suspended from a horizontal or otherwise nonvertical bar by a hanger. Among such articles are those with a length and width much greater than their thickness, such as clothing and floor mats. Representative of such hangers is the one disclosed in U.S. Pat. No. 7,389,885 B2 to Masanek, Jr, fully incorporated by reference herein.

An article hanger for displaying articles for sale usually has a hook for being hung from a display rack bar, and a body that supports the article. Commonly the hanger body has a considerable width. An affixation or gripping member, such as a claw or a clip, may be mounted near each horizontal end of the hanger body and both may be oppositely spaced from a horizontal center of the hanger.

In many such hangers, a hook portion is disposed near the horizontal center of the hanger and/or on or near a vertical hanger axis. The hook portion typically is formed in the same plane as the hanger body. The hook portion is hooked over the display rack bar and, as a result, the article being displayed will be substantially disposed in a vertical plane at a considerable angle to a vertical plane containing the display rack bar, such as 90 degrees.

In some displays of merchandise, a preferred face of the article is exhibited to consumers. It may be desirable to exhibit different ones of multiple articles such that their respective preferred faces are not in parallel planes. It would also be desirable to use the same hanger for each of these differently displayed articles. It further would be desirable to permit the consumer to rotate the hung article relative to the display rack bar, so that the consumer may inspect the entire surface of the article without removing it from the display rack bar, or alternatively while the consumer or other user is holding a handle portion of the hanger.

SUMMARY OF THE INVENTION

According to one aspect of the invention, a hanger is provided for suspending at least one article. The hanger has a hanger body adapted to suspend the article and a hook portion. A receiver of the hanger body is disposed on a vertical axis. A receiver sidewall downwardly extends from a top surface of the hanger body to a lower end. The lower end of the receiver forms a downwardly facing first bushing surface. The hook portion has a body. An axially aligned shank of the hook portion has a shank shaft that downwardly extends from the body of the hook portion to a barb. The barb has an upwardly facing second bushing surface that radially outwardly extends from the shank shaft. The second bushing surface of the barb slidably engages the first bushing surface of the receiver sidewall to thereby rotatably support the hanger body and the suspended article(s).

In one embodiment, the barb has an outer diameter that is larger than an internal diameter of the receiver. The receiver sidewall has an axially aligned first length measured from the top surface of the body to the first bushing surface. The body of the hook portion has a downwardly-facing stop surface from which the shank shaft extends. The shank shaft has an axially aligned second length measured from the stop surface to the second bushing surface. The second length is greater than the first length. When the barb is inserted into the receiver in an interference fit, the receiver sidewall will resiliently flex in a radial outward direction. Since the second length is greater than the first length, the barb may be downwardly overdriven beyond the first bushing surface. In one embodiment, the receiver sidewall is divided into a plurality of sidewall segments by a plurality of slots which upwardly extend from the first bushing surface. This aids in the resilient flexing of the sidewall as the barb is inserted into the receiver.

According to another aspect of the invention, a hanger is provided for displaying a preferred face of an article to a prospective consumer of the article. The hanger comprises a hanger body horizontally extending in a first direction between a left end and a right end. First and second article gripping members are respectively disposed near the first and second ends. The first and second article gripping members are adapted to suspend the article such that the preferred article face faces a second horizontal direction at an angle to the first direction. The hanger body has a top surface. A receiver is disposed on a vertical axis and horizontally between the first and second article gripping members. The receiver downwardly extends from the top surface of the hanger body. A receiver sidewall is formed around the axis and terminates in a lower end, the lower end forming a downwardly facing first bushing surface. The hanger further has a hook portion with a body. A shank of the hook portion has a shank shaft that downwardly extends from the body and terminates in a barb. The barb has an upwardly facing second bushing surface that radially outwardly extends from the shank shaft. The first bushing surface of the hanger body is suspended on the second bushing surface of the barb, such that the first bushing surface slidably engages with the second bushing surface. The hook portion has a hook that is adapted to be suspended from a display bar axis. The hanger body is rotatable to any of a plurality of angles relative to the hook portion, such that the second horizontal direction may be coplanar with the bar axis or may assume any of a plurality of nonzero angles to the bar axis. In one embodiment, the hanger body and hook portion each are molded of a thermoplastic polymer and neither have any metal components.

The hanger of the invention thus may be used to display an article, such as a vehicle floor mat, at any of a number of angles to a display bar axis, and/or permits a prospective consumer to turn the article around on the vertical axis without removing the article from the display bar. The hanger further permits a user to suspend the article by grasping the handle of the hook portion, and to then turn the article around on the axis, so that the user may view both the front and rear sides without removing the hanger from the article or letting go of the handle.

BRIEF DESCRIPTION OF THE DRAWINGS

Further aspects of the invention and their advantages can be discerned in the following detailed description as read in conjunction with the drawings of exemplary embodiments, in which like characters denote like parts and in which.

DETAILED DESCRIPTION

Figure 1:
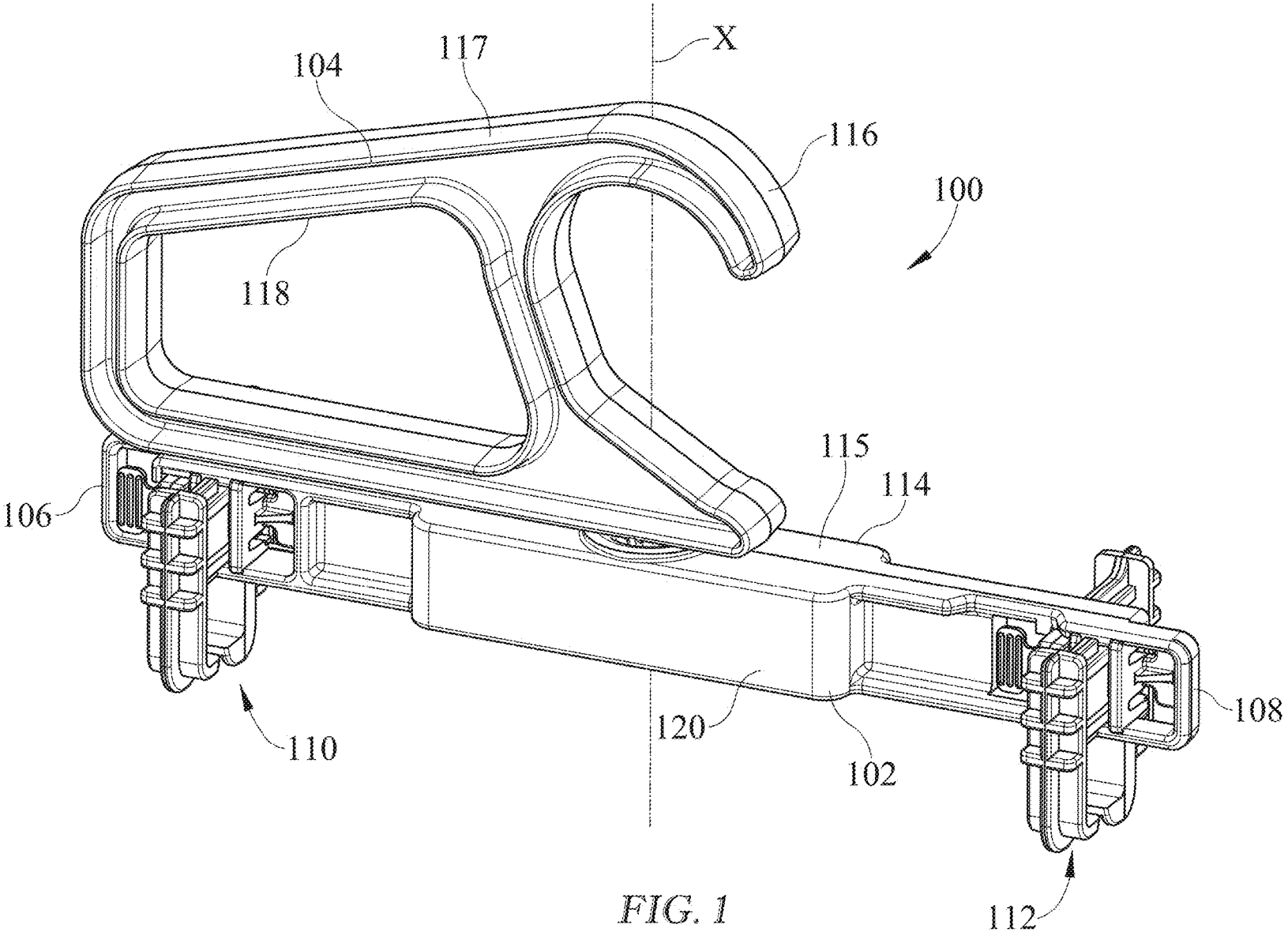
FIG. 1 is a side perspective view of a hanger according to the invention.

As seen in FIG. 1, a hanger 100 includes a hanger body 102 and a hook portion 104. Prior to assembly to the hanger body 102, the hook portion 104 is a separate piece. The hanger body 102 and the hook portion 104 may be separately molded using a compound including a thermoplastic polymer such as ABS. In one embodiment, all of the components of hanger 100 are molded entirely of plastic and incorporate no metal reinforcements. In one embodiment each of hanger body 102 and hook portion is integrally molded of from a single polymer compound, with no second-shot or overmolded components. The polymer compound selected for molding the hanger body 102 may be the same as or different from the polymer compound selected to mold hook portion 104.

Hanger body 102 has a left end 106 horizontally spaced from a central vertical axis X and a right end 108 horizontally spaced, in an opposed direction, from central vertical axis X. The hanger body 102 may have a left article gripping or affixation member 110 adjacent or near left end 106, and a right article gripping or affixation member 112 adjacent or near right end 108. The structure and function of the particularly illustrated gripping members 110 and 112 (and associated mobile claws or clamps) are described in U.S. Pat. No. 7,389,885 B2 to Masanek, Jr., fully incorporated by reference herein. Hanger body 102 may have other gripping or affixation members disposed between gripping members 110 and 112, as might be used for relatively heavy articles or kits having multiple components, and/or the gripping or affixation members may be of different form and operation from those shown.

The hanger body 102 has a top surface 114, so configured that none of hanger body 102 extends above surface 114. A general portion 115 of top surface 114 may be substantially horizontal and flat.

Figure 8:
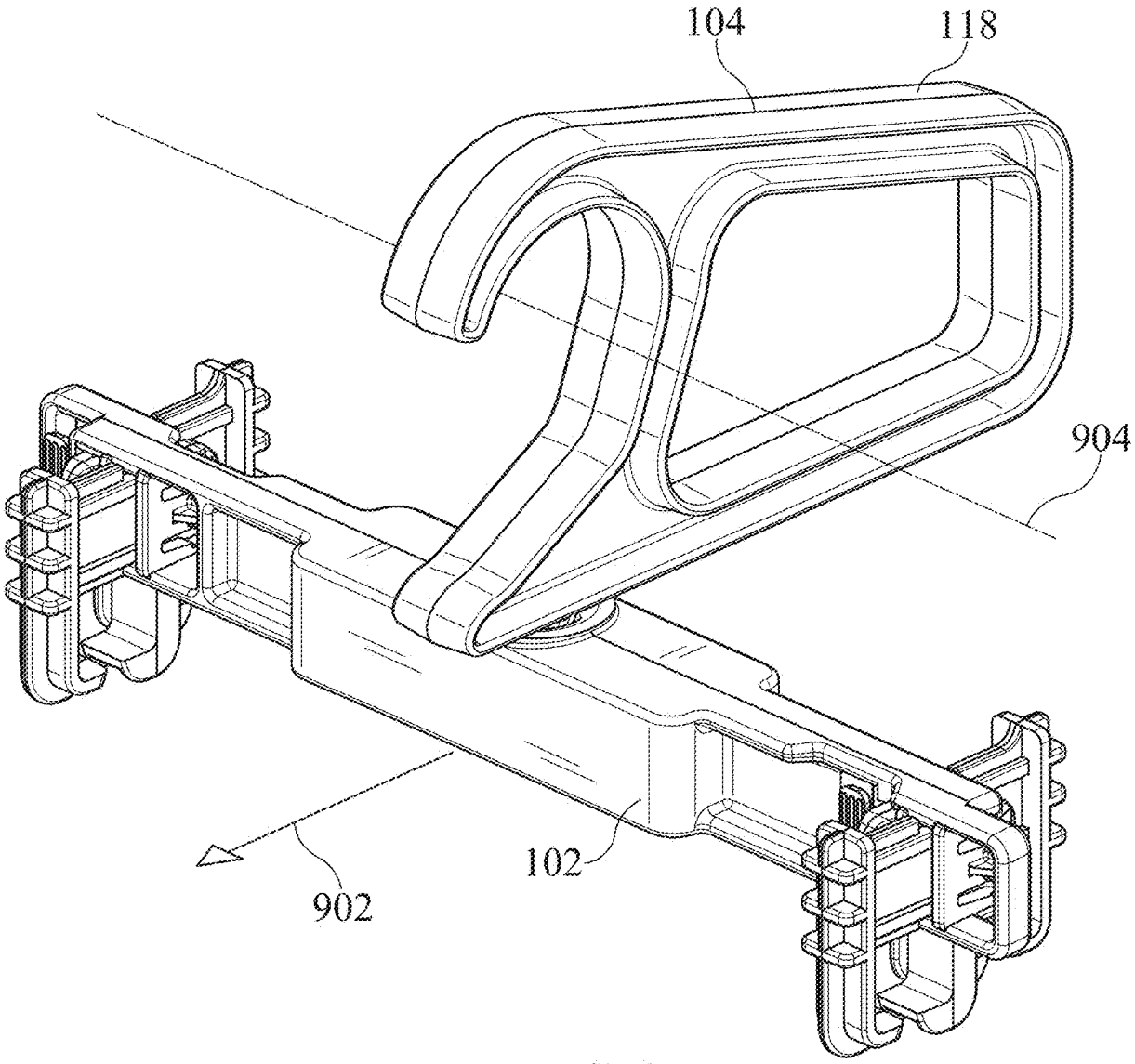
FIG. 8 is a top perspective view of the hanger shown in FIG. 1, with the hanger body rotated 90 degrees with respect to the hook portion.

The hook portion 104 has a body 117 with a hook member 116 that is adapted to fit over a display rack bar (schematically shown at 904 in FIG. 8). In the illustrated embodiment, the body 117 further has a handle portion 118 adapted to be grasped by a human hand, so that a user may suspend the article in place of a display rack bar while the user is inspecting the article.

Hanger body 102 may have a vertically disposed outer wall 120, located near axis X, which may be used to display a trademark, advertising matter or other indicia.

Figure 2:
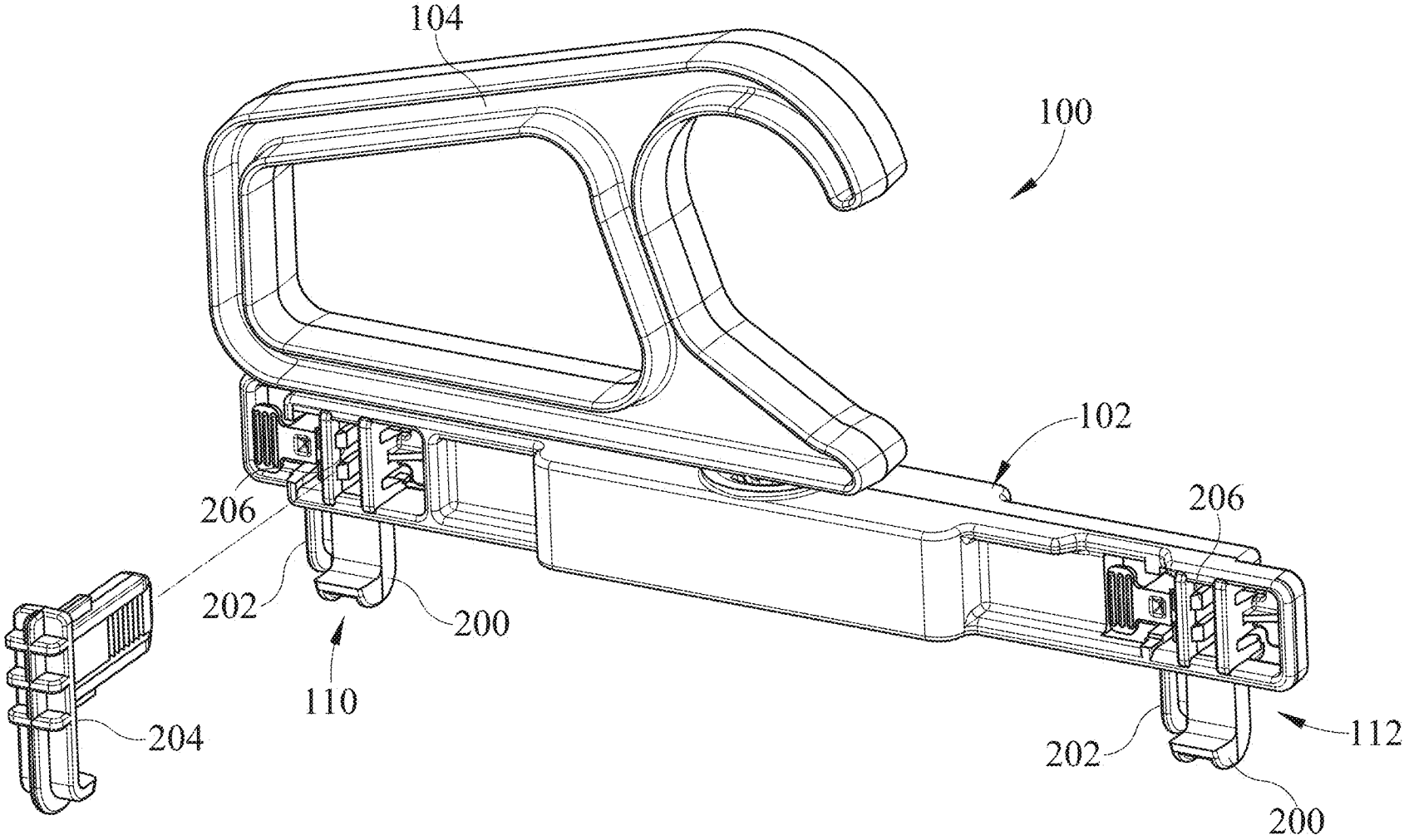
FIG. 2 is a side perspective view of the hanger shown in FIG. 1, with ratcheting jaws removed and a representative one of the ratcheting jaws shown exploded off a hanger body.
Figure 9:
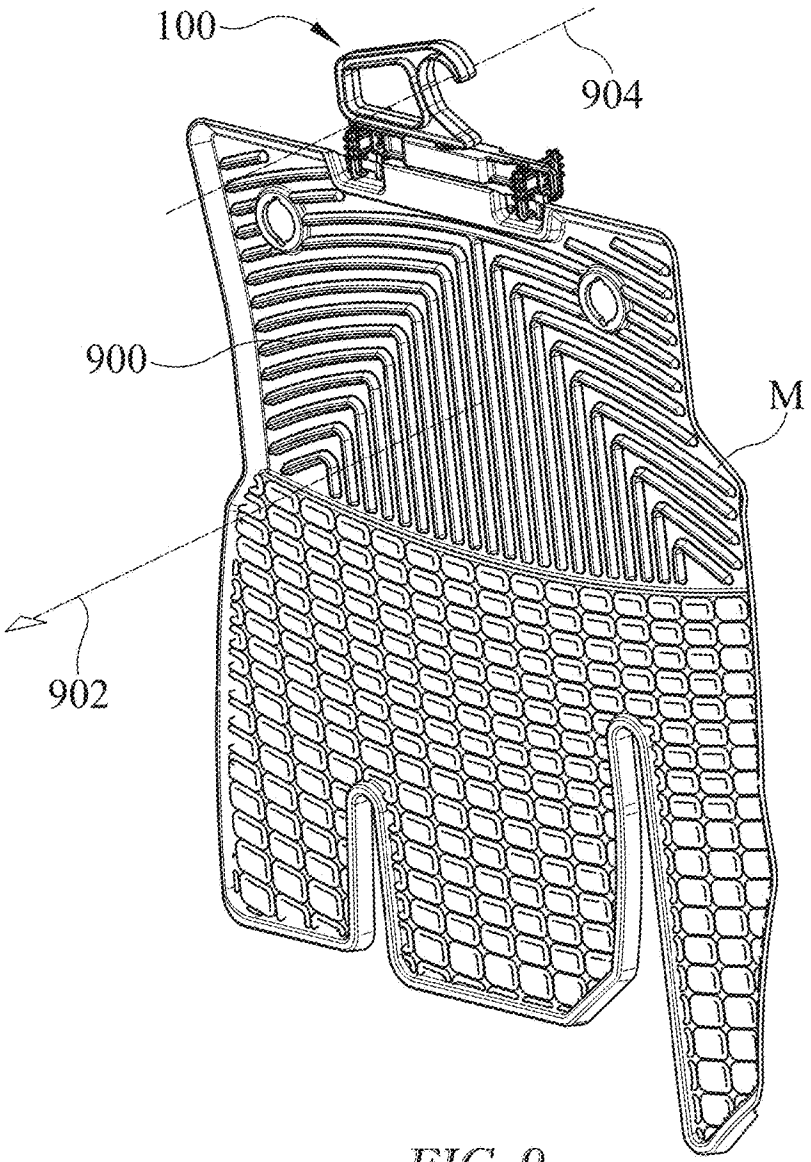
FIG. 9 is a perspective view of a hanger as supporting a displayed flat article.

In one embodiment, each gripping member 110, 112 consists of a pair of stationary jaws 200, 202 (FIG. 2) which face opposite directions, and, for each such stationary jaw, a mobile jaw 204. The mobile jaw 204 is inserted into a respective orifice 206 and is ratcheted closed. Each pair of stationary and mobile jaws clamps to the article to be displayed, such as a vehicle floor mat M as seen in FIG. 9. Further details of the operation of jaws 200-204 are described in U.S. Pat. No. 7,389,885 B2. The illustrated embodiment of hanger 100 has four pairs of jaws 200-204, and is adapted to suspend a set of two vehicle floor mats.

Figure 3:
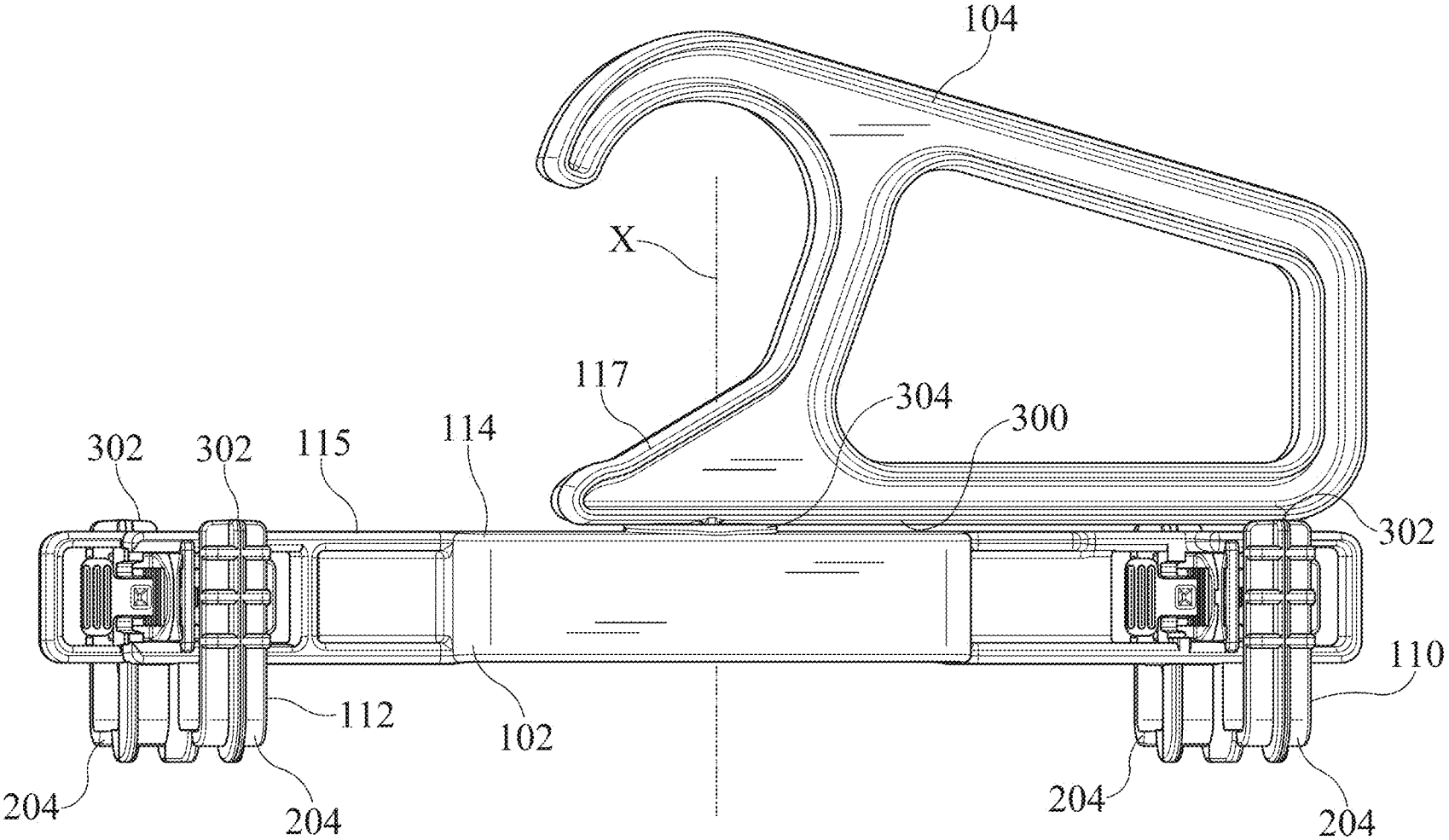
FIG. 3 is a side view of the hanger shown in FIG. 1.
Figure 6:
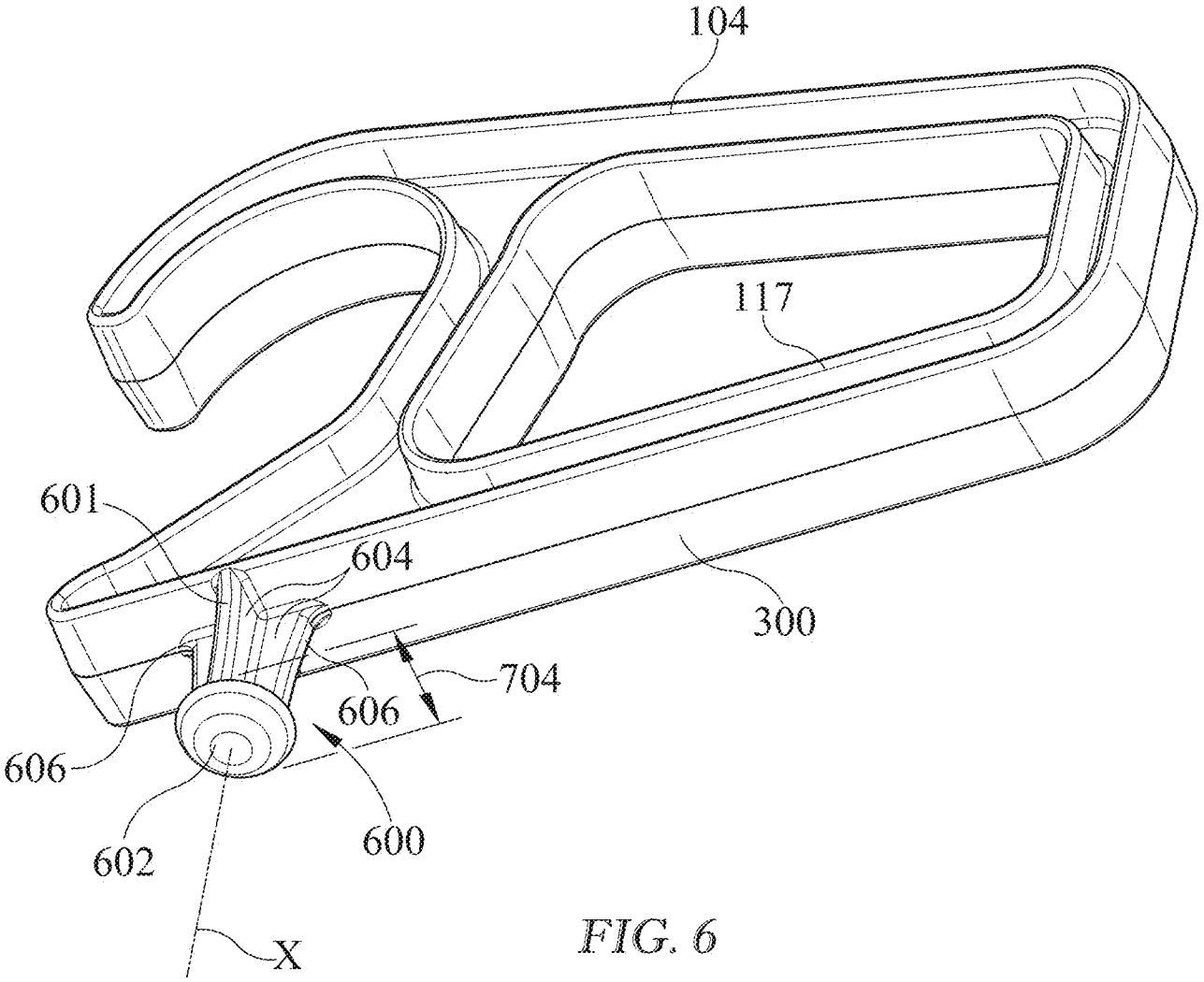
FIG. 6 is a bottom perspective view of a hook portion.

As seen in FIGS. 3 and 6, the hook portion body 117 has a downwardly facing stop surface 300 that, after assembly, will be disposed above top surface 114 of the hanger member 102. Except for a shank (described below), none of hook portion 104 extends below the stop surface 300, and therefore none of the hook portion 104 will interfere with the rotation of body 102 around axis X relative to it.

In the illustrated embodiment, and as seen in FIG. 3, each mobile jaw 204 has a top end 302 which, when the hanger 100 is in an unloaded condition, extends above the plane of stop surface 300. However, when the affixation members 110, 112 are suspending a heavy article such as a rubber vehicle floor mat M, the hanger body 102 will downwardly deflect from the horizontal as a function of the distance from axis X. This amount of downward deflection is enough that the hanger body 102, as including mobile jaws 204 installed into it, will be able to freely rotate with respect to hook portion 104.

Figure 4:
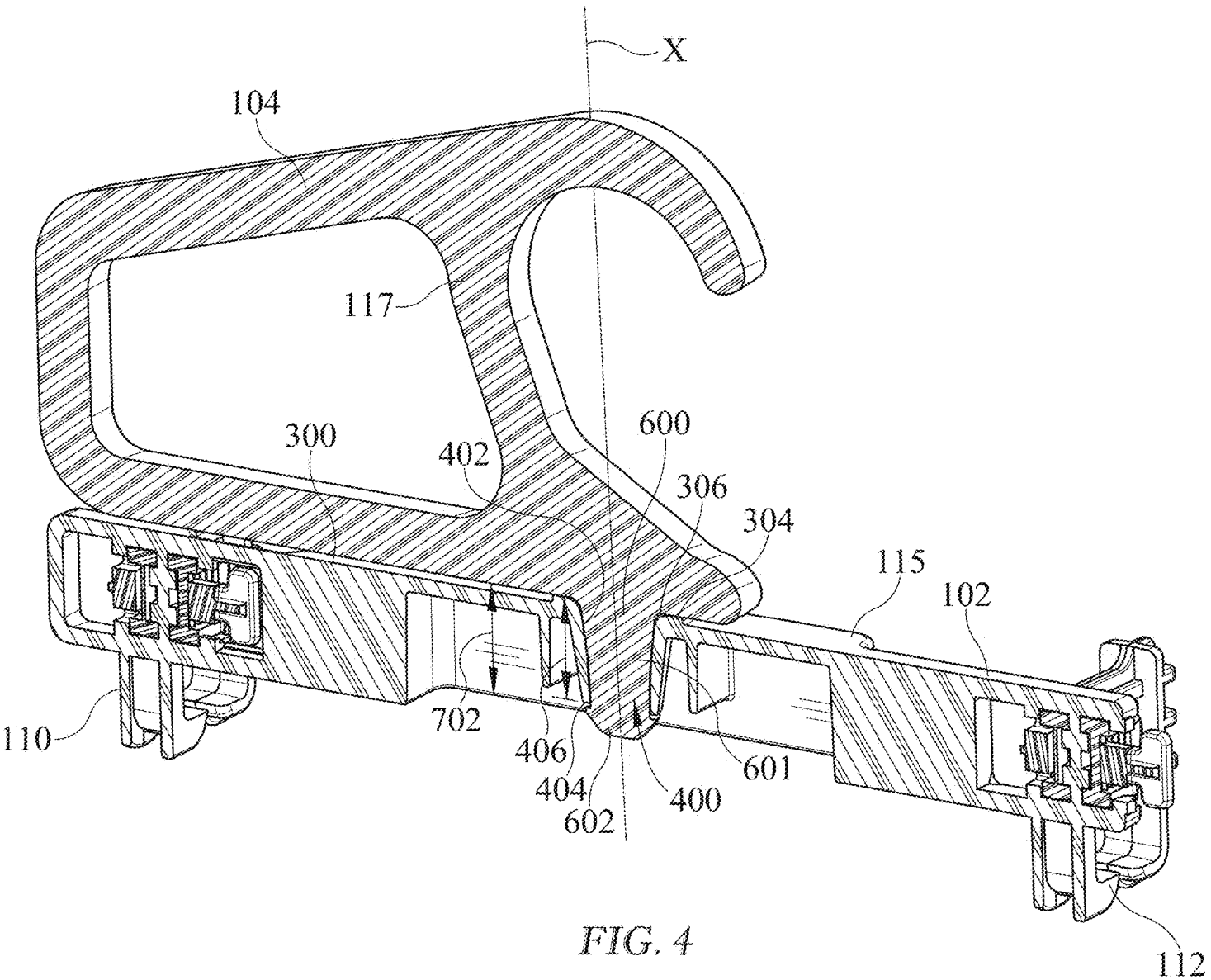
FIG. 4 is an axial sectional view of the body and hook portions of the hanger shown in FIG. 1.

As seen in FIGS. 3 and 4, the top surface 114 of the hanger body 102 is made up by a substantially planar general surface 115 and an annular boss 304, the upper surface 306 of which is upwardly displaced from surface 115. Boss 304 is a reinforcing member designed to better withstand shear force and bending moment imposed by the weight of the article, which will be transmitted through gripping members 110, 112.

As seen in FIG. 4, a shank receiver 400 is disposed on axis X. The shank receiver 400 has a sidewall 402 which downwardly extends from upper surface 306 to a lower end 404. Sidewall 402 may be frustoconical, with an internal diameter which decreases as a function of depth. The sidewall 402 has an axially aligned length 406 measured from surface 306 to end 404.

Figure 5:
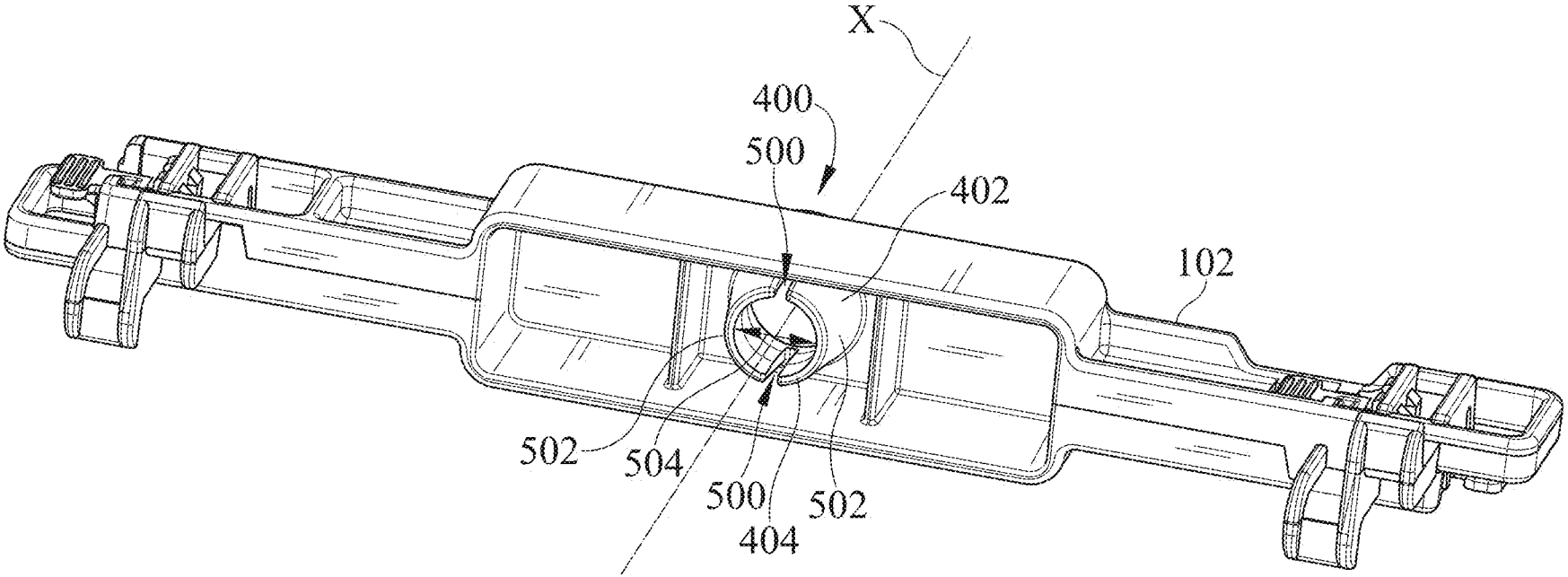
FIG. 5 is a bottom perspective view of a hanger body, showing details of a receiver.

The receiver sidewall 402 should be elastically resilient. In one embodiment, and as seen in FIG. 5, The sidewall 402 has a plurality of lengthwise slots 500, such as two such slots, which divide up sidewall 402 into two or more sidewall segments 502. The slots 500 extend upwardly from lower end 404 for a large portion of the axial length of sidewall 402. This makes each sidewall segment 502 more resiliently deflectable when a barb of the shank (both described below) is pushed through the receiver 400 in an interference fit. As further described below, the lower end 404 of the receiver 400 is a flat annulus and acts as a load-transmitting bushing surface. Sidewall 402 has an internal diameter 504 at its lower end 404.

As seen in FIGS. 4 and 6, a shank 600 of the hook portion 104 has a shaft 601 that downwardly extends from stop surface 300 to terminate in a barb 602. The shank shaft 601 may be cruciform in construction and may be composed of a number of axially aligned, radially extending, and angularly spaced apart plates 604. Each plate 604 has a radial outer surface 606 which is downwardly and inwardly angled, the angle and shape of which may match that of sidewall 402 once the barb 602 has been pushed to below the bushing surface 404.

Figure 7:
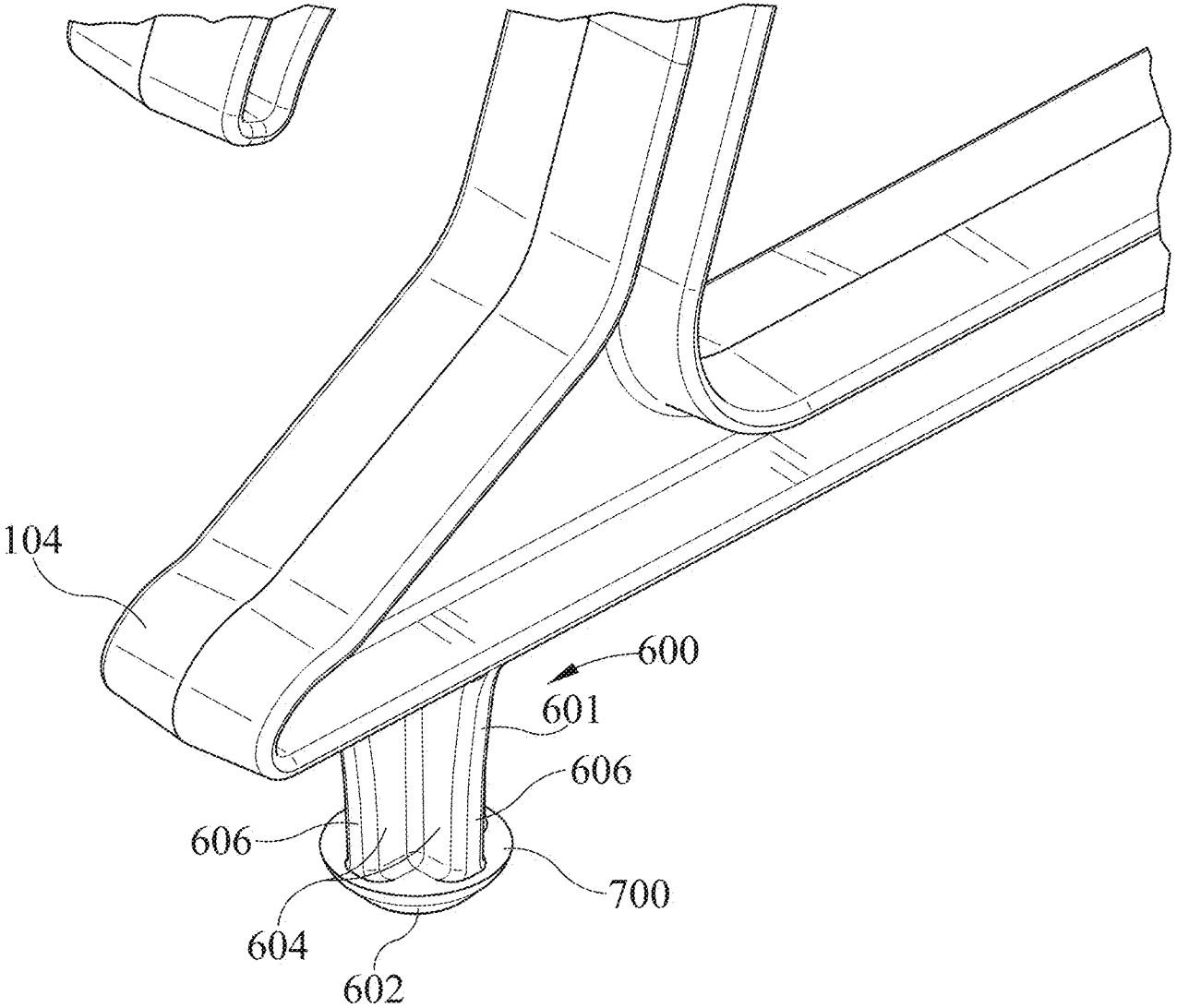
FIG. 7 is a top side perspective detail of a shank and barb of the hook portion.

As seen in FIG. 7, the shank plates 604 terminate at an upper surface 700 of the barb 602. The upper surface 700 is flat and outwardly extends from shank plate surfaces 606, creating an upwardly facing, annular bushing. Bushing surface 700 and barb 602 have an outer diameter 704 (FIG. 6) which is greater than sidewall inner diameter 504 (FIG. 5). As seen in FIG. 4, an axially aligned length 702 of shank 400 between stop surface 300 and bushing surface 700 is at least slightly greater than axial sidewall length 406. This is to permit an amount of overdrive when shank 600 is forced into and partly through receiver 400. After barb 602 clears receiver sidewall end 404, the sidewall segments 502 temporarily outwardly deflected by barb 602 will snap back, fastening hook portion 104 to hanger body 102.

Once the hook portion 104 has been installed into the receiver 400 of the body portion 102, downwardly facing bushing surface 404 will contact upwardly facing bushing surface 700. The entire weight of body 102 and the article(s) it is suspending will be transmitted by surface 404 to surface 700. Shank shaft 601 may freely rotate inside of shank receiver 400, and as this happens, bushing surface 404 slides on bushing surface 700.

As seen in FIG. 9, an article to be displayed, such as a vehicle floor mat M, may be flat and may have a preferred face 900 that advantageously may be presented to an inspecting consumer. The face 900 faces a horizontal direction 902. In the configuration shown in FIG. 9, direction 902 is aligned with an axis of a schematically illustrated bar 904 from which hanger 100 is suspended. In this configuration, the retailer can store a lot of mats M along the bar 904, each parallel to the other—but only the one on the end will be really visible to the consumer, and only one face of it.

However, and as seen in FIG. 8, the invention permits the body 102 to be rotated so that direction 902 is at a considerable angle to bar 904, such as ninety degrees. This could be done where a representative article is hung midway along a display rack, or on an end.

A further advantage of the invention is that a consumer may rotate the body 102 (and therefore the article) without removing the hanger 100 from the supporting bar 904. And, either a consumer or a salesperson could support the article by handle 118, and while being so supported, freely rotate the hanger body 102 and the suspended article within the volume beneath hook portion 104. In this way, a consumer may easily inspect all faces of the article, without regrasping the handle 118 or letting go of it.

In summary, an improved article hanger has been provided in which a body of the hanger may be freely rotated relative to a hook portion thereof, such that the article suspended from the hanger body may be made to face any of an infinite number of directions. The hook portion snaps into a receiver in the hanger body. After assembly, an annular bushing surface of the hanger body rides on a bushing surface of the hook portion.

While illustrated embodiments of the present invention have been described and illustrated in the appended drawings, the present invention is not limited thereto but only by the scope and spirit of the appended claims.

We claim:

1. A hanger for suspending at least one article, the hanger comprising:

a hanger body adapted to suspend the at least one article, the hanger body having a top surface, a hollow receiver integrally molded with the hanger body, the receiver disposed on a vertical axis and downwardly extending from the top surface of the hanger body and having a receiver sidewall, a lower end of the receiver sidewall forming a downwardly facing first bushing surface, the inner sidewall having an axially aligned first length between the top surface of the body and the first bushing surface;

a hook portion having a body and an axially aligned shank, a shank shaft downwardly extending from the body through the receiver and terminating in a barb, the barb having an upwardly facing second bushing surface radially outwardly extending from the shank shaft; wherein the second bushing surface of the barb slidably engages the first bushing surface of the receiver sidewall to thereby rotatably support the hanger body and the at least one article; and wherein the body of the hook portion has a downwardly facing stop surface, the shank shaft downwardly extending from the stop surface to the second bushing surface by an axially aligned second length, the second length being greater than the first length so as to permit the barb to be downwardly overdriven beyond the first bushing surface, and wherein the hanger body includes at least first and second article gripping members horizontally displaced from the receiver, top ends of the first and second article gripping members being disposed above the stop surface of the hook portion body when the hanger body is in an unloaded condition, the hanger body downwardly deflecting when the hanger body is in a loaded condition caused by suspending the at least one article, the top ends of the article gripping members disposed below the stop surface when the hanger body is in the loaded condition, thereby allowing the hanger body to freely rotate on the shank shaft.

2. A hanger for suspending at least one article, the hanger comprising:

a hanger body adapted to suspend the at least one article, the hanger body having a top surface, a hollow receiver integrally molded with the hanger body, the receiver disposed on a vertical axis and downwardly extending from the top surface of the hanger body and having a receiver sidewall, a lower end of the receiver sidewall forming a downwardly facing first bushing surface, the inner sidewall having an axially aligned first length between the top surface of the body and the first bushing surface;

a hook portion having a body and an axially aligned shank, a shank shaft downwardly extending from the body through the receiver and terminating in a barb, the barb having an upwardly facing second bushing surface radially outwardly extending from the shank shaft; wherein the second bushing surface of the barb slidably engages the first bushing surface of the receiver sidewall to thereby rotatably support the hanger body and the at least one article; and wherein the body of the hook portion has a downwardly facing stop surface, the shank shaft downwardly extending from the stop surface to the second bushing surface by an axially aligned second length, the second length being greater than the first length so as to permit the barb to be downwardly overdriven beyond the first bushing surface, and wherein the hook portion is integral, is molded from a thermoplastic polymer, and has no metal components.

3. The hanger of claim 2, wherein the barb has an outer diameter and the receiver sidewall has an inner diameter, and wherein in assembling the hook portion to the hanger body, the barb is inserted into the receiver in an interference fit, causing the receiver sidewall to resiliently radially outwardly flex, until the bar is disposed below the receiver sidewall and the second bushing surface is disposed below the first bushing surface.

4. The hanger of claim 3, wherein the receiver sidewall is split into at least two sidewall segments by at least two slots upwardly extending from the first bushing surface, the at least two slots slot aiding the radial outward flexure of the sidewall segments when the barb is inserted into the receiver.

5. The hanger of claim 2, wherein the second bushing surface is annular.

6. The hanger of claim 4, wherein the first bushing surface is an annulus divided into a plurality of angular segments.

7. The hanger of claim 2, wherein the hook portion comprises a hook adapted to be suspended from a bar of a display, and a handle portion formed on an angle to the axis and adapted to be grasped by a hand of a user.

8. The hanger of claim 2, wherein the hook portion is molded from a compound including ABS.

9. The hanger of claim 2, wherein the hanger body is integral, is molded from a thermoplastic polymer, and has no metal components.

10. The hanger of claim 9, wherein the hanger body is molded from a compound including ABS.

11. A hanger for displaying a preferred face of an article to a consumer of the article, the hanger comprising:

a hanger body horizontally extending in a first direction between a left end and a right end, a first article gripping member disposed near the first end of the hanger body, a second article gripping member disposed near the second end of the hanger body, the first and second article gripping members adapted to suspend the article such that the preferred face faces a horizontal second direction at an angle to the first direction;

the hanger body having a top surface, a receiver integrally molded with the hanger body and disposed on a vertical axis and downwardly extending from the top surface of the hanger body, a receiver sidewall formed around the axis and terminating in a lower end, a downwardly facing first bushing surface formed at the lower end of the receiver sidewall, the receiver horizontally disposed between the first article gripping member and the second article gripping member; and a hook portion having a body, a shank having a shank shaft downwardly extending from the body of the hook portion and terminating in a barb, the barb having an upwardly facing second bushing surface radially outwardly extending from the shank shaft;

the first bushing surface of the hanger body being suspended on the second bushing surface of the barb such that the first bushing surface slidably engages with the second bushing surface;

the hook portion having a hook adapted to be suspended from a display bar having a display bar axis, the hanger body rotatable to any of a plurality of angles relative to the hook portion, such that the preferred face of the article may be displayed at any of a plurality of angles to the bar axis, wherein the second bushing surface has a first diameter and the receiver sidewall has a second diameter smaller than the first diameter, an axially aligned first length of the receiver sidewall measured between the top surface of the body and the first bushing surface, the body of the hook portion having a downwardly facing stop surface from which the shank shaft downwardly extends, an axially aligned second length of the shank shaft measured between the stop surface and the second bushing surface, the second length being greater than the first length so as to allow the barb to be overdriven beyond the first bushing surface, wherein the hook portion is molded from a polymer compound including ABS.

12. The hanger of claim 11, wherein the hanger body is molded from a polymer compound including ABS.

13. A hanger for displaying a preferred face of an article to a consumer of the article, the hanger comprising:

a hanger body horizontally extending in a first direction between a left end and a right end, a first article gripping member disposed near the first end of the hanger body, a second article gripping member disposed near the second end of the hanger body, the first and second article gripping members adapted to suspend the article such that the preferred face faces a horizontal second direction at an angle to the first direction;

the hanger body having a top surface, a receiver integrally molded with the hanger body and disposed on a vertical axis and downwardly extending from the top surface of the hanger body, a receiver sidewall formed around the axis and terminating in a lower end, a downwardly facing first bushing surface formed at the lower end of the receiver sidewall, the receiver horizontally disposed between the first article gripping member and the second article gripping member; and a hook portion having a body, a shank having a shank shaft downwardly extending from the body of the hook portion and terminating in a barb, the barb having an upwardly facing second bushing surface radially outwardly extending from the shank shaft;

the first bushing surface of the hanger body being suspended on the second bushing surface of the barb such that the first bushing surface slidably engages with the second bushing surface;

the hook portion having a hook adapted to be suspended from a display bar having a display bar axis, the hanger body rotatable to any of a plurality of angles relative to the hook portion, such that the preferred face of the article may be displayed at any of a plurality of angles to the bar axis, wherein the second bushing surface has a first diameter and the receiver sidewall has a second diameter smaller than the first diameter, an axially aligned first length of the receiver sidewall measured between the top surface of the body and the first bushing surface, the body of the hook portion having a downwardly facing stop surface from which the shank shaft downwardly extends, an axially aligned second length of the shank shaft measured between the stop surface and the second bushing surface, the second length being greater than the first length so as to allow the barb to be overdriven beyond the first bushing surface, wherein top ends of the first and second article gripping members are disposed above the stop surface of the hook portion body when the hanger body is in an unloaded condition, the hanger body downwardly deflecting when the hanger body is in a loaded condition caused by suspending the article, the top ends of the article gripping members being disposed below the stop surface of the hook portion body when the hanger body is in the loaded condition, thereby allowing the hanger body to freely rotate on the shank shaft.

14. The hanger of claim 13 wherein the article is a vehicle floor mat.

* * * * *